US006134995A

United States Patent [19]

Shiao

[11] Patent Number: 6,134,995

[45] Date of Patent: Oct. 24, 2000

[54] HAND OPERATED TOOL WITH A REMOVABLE ROTARY BIT RETAINING MEMBER

[76] Inventor: Hsuan-Sen Shiao, No. 15-1, Lane 369, Min-Chuan Rd., Taichung City, Taiwan

[21] Appl. No.: 09/313,996

[22] Filed: May 19, 1999

[51] Int. Cl.[7] ..... B25B 23/00

[52] U.S. Cl. ..... 81/439; 81/177.4; 81/490

[58] Field of Search ..... 81/177.4, 438, 81/439, 490

[56] References Cited

U.S. PATENT DOCUMENTS

| | | | |
|---|---|---|---|
| 4,572,038 | 2/1986 | Graham | 81/439 |
| 4,893,529 | 1/1990 | Lin | 81/177.1 |
| 4,989,480 | 2/1991 | Chen | 81/439 |
| 5,337,637 | 8/1994 | Bih-Lien | 81/439 |

*Primary Examiner*—James G. Smith
*Assistant Examiner*—David B. Thomas
*Attorney, Agent, or Firm*—Liniak, Berenato, Longacre & White

[57] ABSTRACT

A hand operated tool includes a tubular casing having an end wall formed with a through hole offset from an axis thereof, and a circumferential wall that extends coaxially from the end wall to form an open end and that confines a receiving space. A mounting axle extends coaxially from the end wall into the receiving space. A cover member is mounted on the circumferential wall and is movable relative thereto between a first position, where the cover member covers the open end, and a second position, where the cover member uncovers the open end. A rod retention tube extends from the cover member outwardly of the receiving space, and is aligned with the through hole in the end wall and is in communication with the receiving space when the cover member is at the first position. A rotary bit retaining member is inserted removably into the receiving space when the cover member is at the second position. The bit retaining member is sleeved rotatably on the mounting axle, and has a plurality of bit retaining holes to receive a plurality of tool bits, respectively. A push rod is slidably disposed in the rod retention tube, and has operating portion that extends outwardly from the rod retention tube and that is operable to force the tool bit in a selected one of the bit retaining holes to extend through the through hole in the end wall.

17 Claims, 8 Drawing Sheets

HAND OPERATED TOOL WITH A REMOVABLE ROTARY BIT RETAINING MEMBER

FIELD OF THE INVENTION

The invention relates to a hand operated tool, more particularly to a hand operated tool with a removable rotary bit retaining member.

BACKGROUND OF THE INVENTION

Referring to FIGS. 1 and 2, a conventional hand operated tool is shown to include a tubular casing 1, a bit operating tube 2, a cylindrical rotary bit retaining member 3, a hand grip member 7, a coupler member 4, a push rod 57 and a plurality of tool bits 6.

As illustrated, the tubular casing 1 includes a first end wall 103 which has an axis and a mounting hole 102 formed therethrough and offset from the axis, a second end wall 104, and a circumferential wall 101 that interconnects the first and second end walls 103, 104 to confine a receiving space 101C therebetween. The circumferential wall 101 is formed with a cut-out portion for access into the receiving space 101C. The second end wall 104 has a central hole 104C formed therethrough, a recess portion 104R formed in an outer surface thereof, and a pair of screw mounting posts 106 extending from an innermost wall of the recess portion 104R outwardly of the receiving space 101C. The innermost wall of the recess portion 104R further has an eccentric through hole 105 aligned with the mounting hole 102 in the first end wall 103 and in communication with the receiving space 101C.

The bit operating tube 2 has a connecting portion 202 mounted non-rotatably and securely in the mounting hole 102 of the first end wall 103, and an operating portion 201 that extends outwardly of the receiving space 101C.

The rotary bit retaining member 3 is disposed rotatably in the receiving space 101C of the tubular casing 1, and has an outer periphery 305, an axial mounting hole 301 aligned with the central hole 104C in the second end wall 104, and a plurality of axially extending bit retaining holes 302 disposed along a circular line between the mounting hole 301 and the outer periphery 305. The plurality of tool bits 6 are disposed in the bit retaining holes 302, respectively.

The coupler member 4 includes a mounting plate 401 press-fitted into the recess portion 104R of the second end wall 104, and a grip mounting portion 403 which has two lateral retention slots 404 that permit extension of the screw mounting posts 106 therethrough outwardly of the receiving space 101C. The mounting plate 401 is formed with a retention shaft 402 that extends through the central hole 104C in the second end wall 104 and the mounting hole 301 in the bit retaining member 3 to prevent removal of the bit retaining member 3 from the receiving space 101C of the tubular casing 1. Under such a condition, the bit retaining member 3 is externally accessible via the cut-out portion to rotate the same and align the tool bit 6 in a selected one of the bit retaining holes 302 with the bit operating tube 2 and the eccentric through hole 105 in the second end wall 104.

Two fastener screws 701 extend through the hand grip member 7 to engage the screw mounting posts 106 so as to mount the hand grip member 7 and the tubular casing 1. The grip member 7 has an axially extending slot 702 to slidably received the push rod 5 therein. For operating on a workpiece, the bit retaining member 3 is rotated externally to align a desired tool bit 6 with the bit operating tube 2. The push rod 5 is then pushed against the biasing action of a spring 702 toward the bit retaining member 3 so as to expose an operating tip of the desired tool bit 6 outwardly of the bit operating tube 2.

A drawback of the aforesaid hand operated tool resides in that the bit retaining member 3 is not removable from the receiving space 101C of the tubular casing 1, thereby limiting the number of assorted tool bits that can be applied thereto.

In addition, rotation of the hand grip member 7 results in corresponding rotation of the other components of the tool. As such, the tool requires a relatively large operating space, thereby making it difficult to operate in cramped spaces. Moreover, the tool requires a relatively large amount of applied force when operating on a workpiece.

SUMMARY OF THE INVENTION

The main object of this invention is to provide a hand operated tool with a removable rotary bit retaining member so as to increase the number of assorted tool bits that can be applied thereto.

Another object of this invention is to provide a hand operated tool that requires a relatively small amount of operating space, thereby making it ideal for use in cramped spaces.

A further object of this invention is to provide a hand operated tool that requires a relatively small amount of applied force when operating on a workpiece.

Accordingly, the hand operated tool of the present invention includes a tubular casing, a locking device, a cylindrical rotary bit retaining member, a plurality of tool bits, and a push rod. The tubular casing includes an end wall having an axis and a through hole formed therethrough and offset from the axis, and a circumferential wall that extends coaxially from the end wall to form an open end opposite to the end wall. The circumferential wall confines a receiving space between the end wall and the open end, and is formed with a cut-out portion for access into the receiving space. A mounting axle extends coaxially from the end wall into the receiving space. A cover member is mounted on the circumferential wall and is movable relative thereto between a first position, where the cover member covers the open end, and a second position, where the cover member uncovers the open end. The cover member has a rod retention tube that projects outwardly of the receiving space. The rod retention tube is aligned with the through hole in the end wall and is in communication with the receiving space when the cover member is at the first position. The locking device releasably locks the cover member at the first position. The rotary bit retaining member is inserted removably into the receiving space from the open end of the circumferential wall when the cover member is at the second position. The bit retaining member has a outer periphery, an axial mounting hole for sleeving rotatably the bit retaining member on the mounting axle inside the receiving space, and a plurality of axially extending bit retaining holes disposed along a circular line between the mounting hole and the outer periphery. The bit retaining member is accessible externally of the casing via the cut-out portion so as to rotate the bit retaining member about the mounting axle in order to align a selected one of the bit retaining holes with the through hole in the end wall and the rod retention tube. The tool bits are disposed in the bit retaining holes of the bit retaining member, respectively. The push rod has a bit pushing portion slidably extending into the rod retention tube, and an operating portion that extends outwardly from the rod retention tube and operable so that when the cover member is at the first position, the bit pushing portion can force the tool bit in the selected one of the bit retaining holes to extend through the through hole in the end wall.

Preferably, the end wall of the casing is further formed with a hollow sleeve member disposed around the through hole and extends outwardly of the receiving space parallel with the mounting axle. The tool bit in the selected one of the bit retaining holes is forced by the bit pushing portion to extend into the hollow sleeve member.

Preferably, a bit operating tube is disposed rotatably in the hollow sleeve member such that the tool bit in the selected one of the bit retaining holes is forced by the bit pushing portion to extend into the bit operating tube.

Each of the tool bits, preferably, has a tube engaging portion, and an operating tip that extends from the tube engaging portion. The tube engaging portion and the bit operating tube are of a non-circular cross section. The bit operating tube confines a bit passage of a non-circular cross-section that conforms with the non-circular cross-section of the tube engaging portions of the tool bits and the bit pushing portion of the push rod to permit simultaneous rotation of the bit operating tube with the push rod and the tool bit in the bit operating tube.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
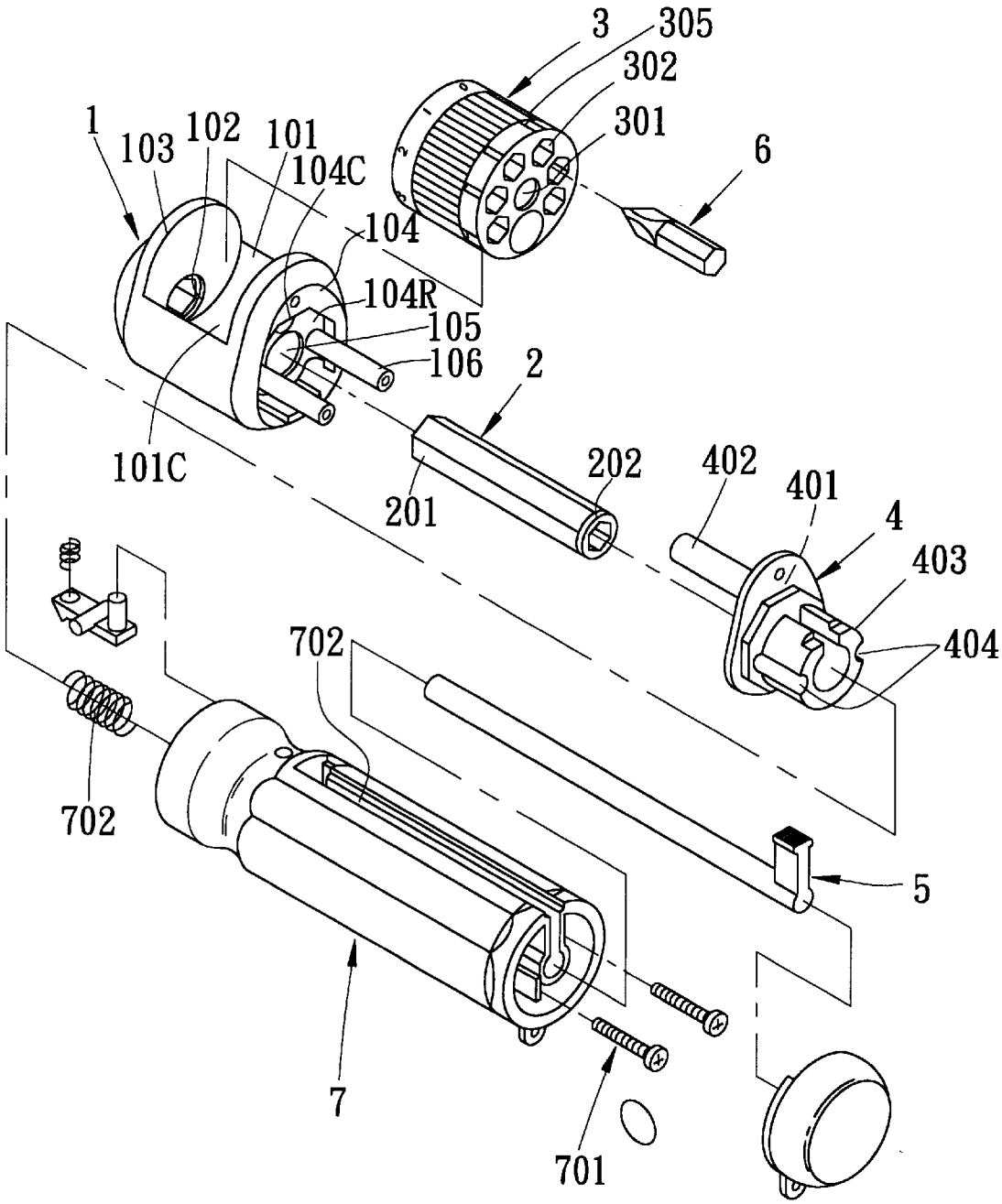
FIG. 1 PRIOR ART
FIG. 1 is an exploded view of a conventional hand operated tool.
Figure 2:
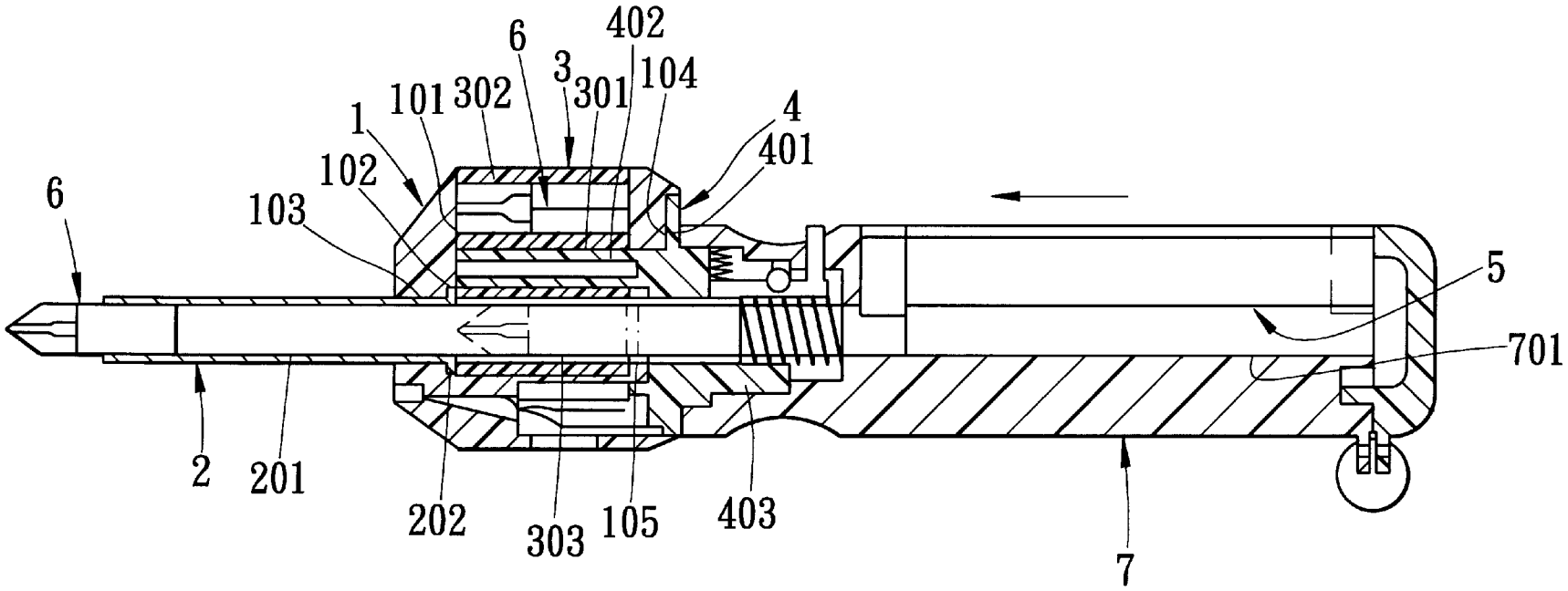
FIG. 2 PRIOR ART
FIG. 2 is a fragmentary sectional view of the conventional hand operated tool.
Figure 3:
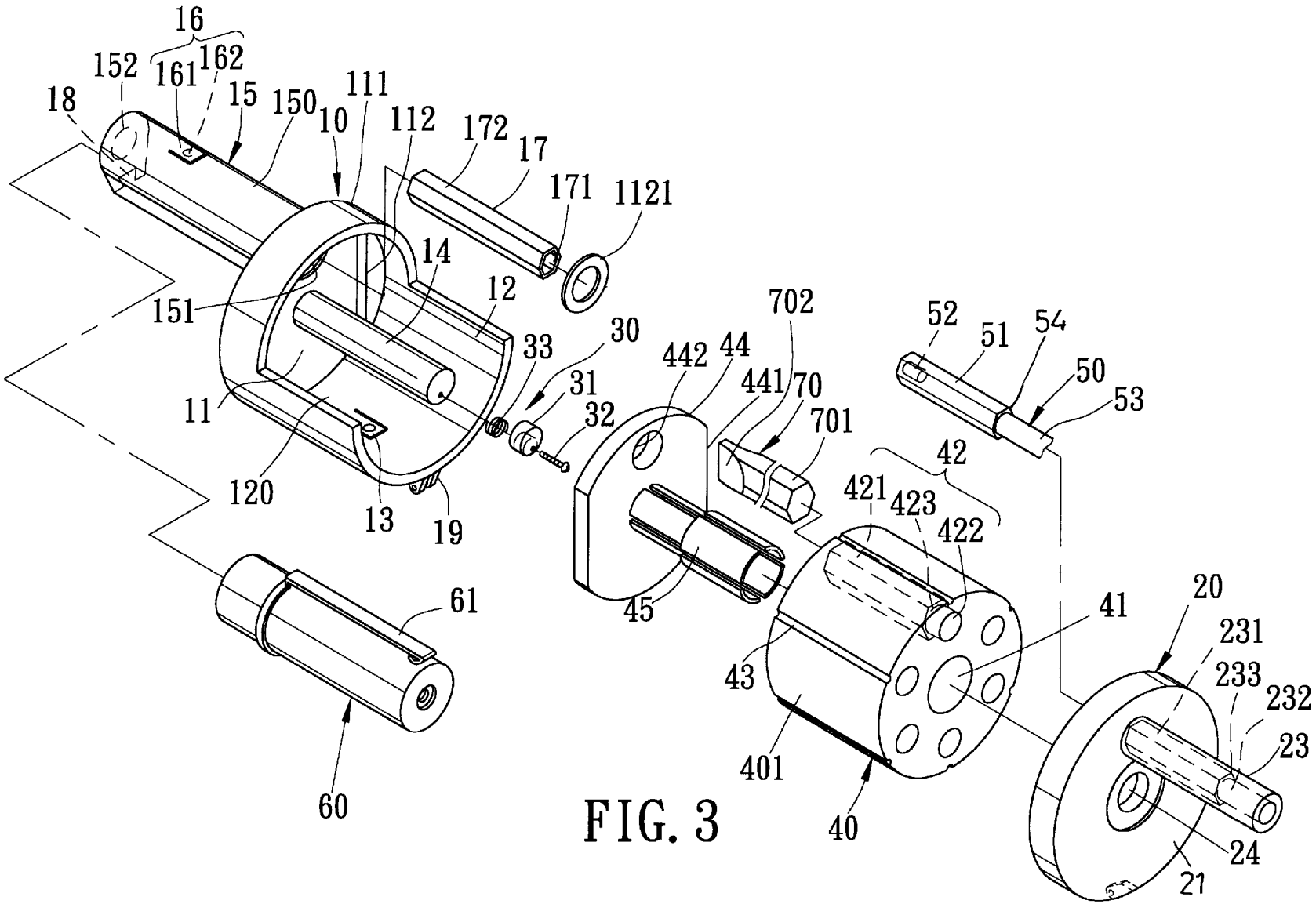
FIG. 3 is an exploded view of a preferred embodiment of a hand operated tool of the present invention.
Figure 4:
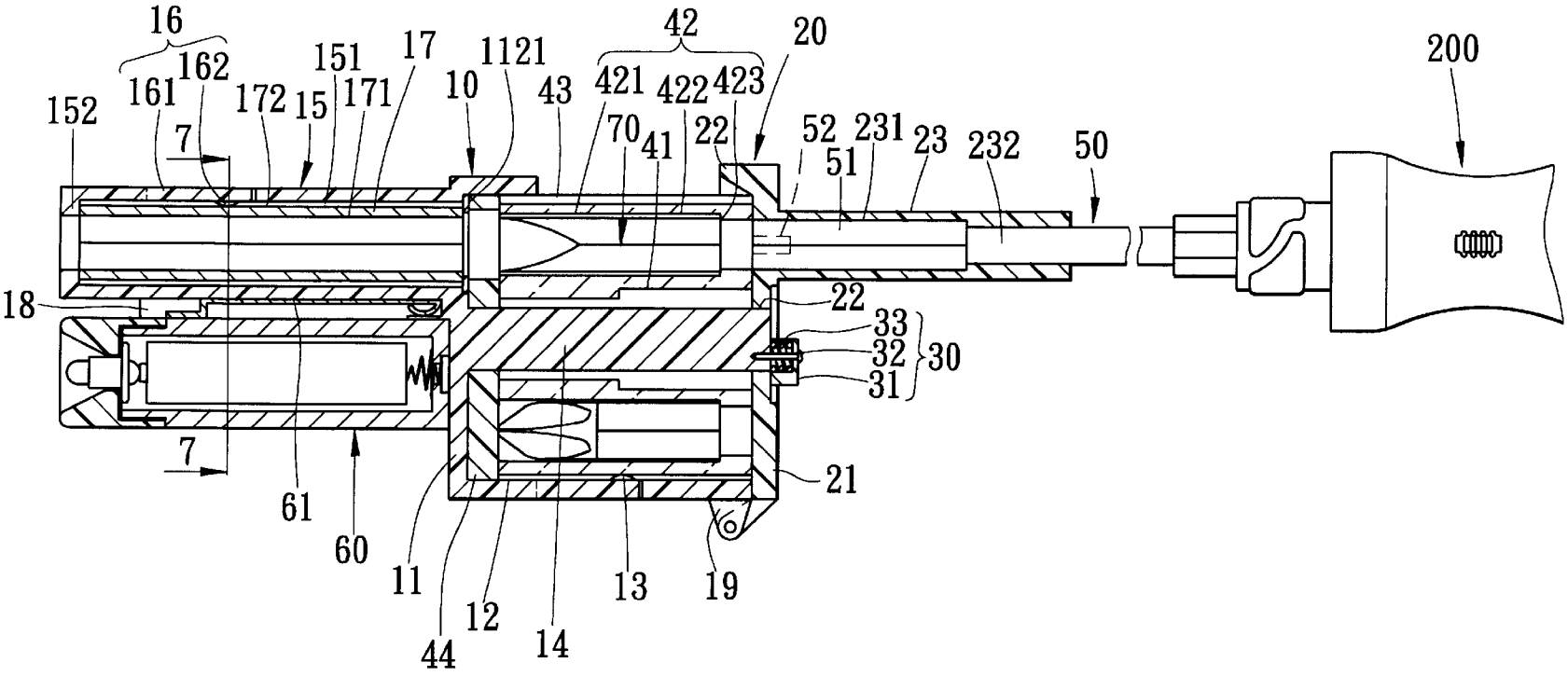
FIG. 4 is a fragmentary sectional view of the preferred embodiment in a non-use position.

Referring to FIGS. 3 and 4, the preferred embodiment of a hand operated tool according to the present invention is shown to include a tubular casing 10, a locking device 30, a cylindrical rotary bit retaining member 40, a plurality of tool bits 70, and a push rod 50.

As illustrated, the tubular casing 10 includes an end wall 11 which has an axis and a through hole 151 formed therethrough and offset from the axis, and a circumferential wall 111 that extends coaxially from the end wall 11 to form an open end 12 and that confines a receiving space 120 between the end wall 11 and the open end 12. The circumferential wall 111 is formed with a cut-out portion for access into the receiving space 120. The end wall 11 is further formed with a mounting axle 14 that extends coaxially into the receiving space 120, and a hollow sleeve member 15 that is disposed securely around the through hole 151 and that extends outwardly of the receiving space 120 parallel to the mounting axle 14. A bit operating tube 17 is disposed rotatably in the hollow sleeve member 15, and confines a bit passage 171 therethrough, the purpose of which will be described in the following paragraphs.

A cover member 20 includes a cover plate 21, and a peripheral wall 22 that extends from the cover plate 21 toward the open end 12 of the circumferential wall 111. A pivot member 19 is mounted on the circumferential wall 111 and extends through the peripheral wall 22 along a pivot axis that is transverse to the mounting axle 14. Thus, the cover member 20 is movable about the pivot member 19 between a first position, where the cover member 20 covers the open end 12 of the circumferential wall 111, and a second position, where the cover member 20 uncovers the open end 12 of the circumferential wall 111 (see FIG. 6). The cover plate 21 is formed with an opening 24 aligned with the mounting axle 14.

The cover member 20 further has a rod retention tube 23 that extends from the cover plate 21 to project outwardly of the receiving space 120. The rod retention tube 23 is aligned with the through hole 151 in the end wall 11. The rod retention tube 23 is in communication with the receiving space 120 when the cover member 20 is at the first position. At the first position, the cover plate 21 can be fastened releasably to the mounting axle 14 with the use of the locking device 30.

Figure 6:
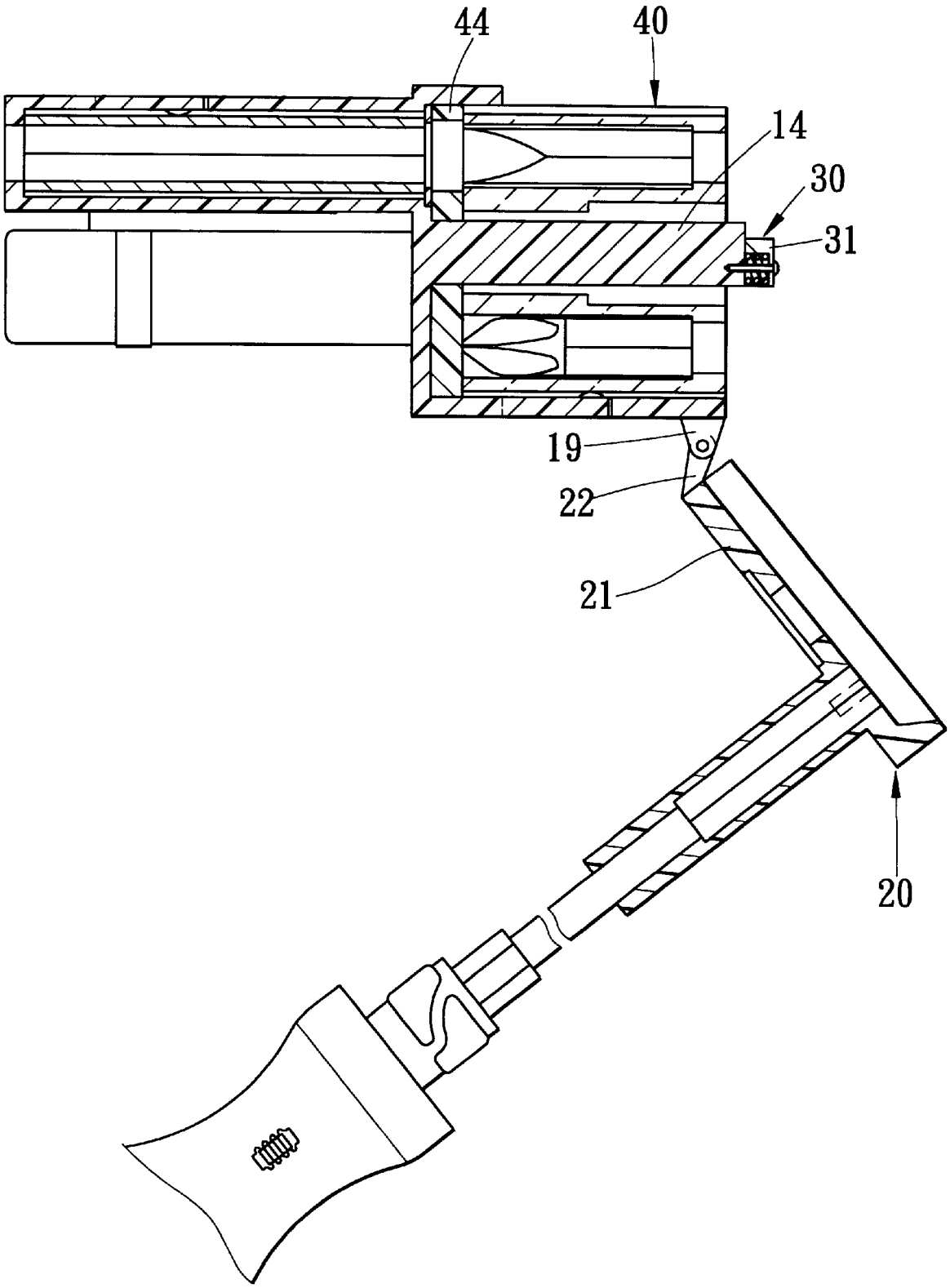
FIG. 6 is a fragmentary sectional view of the preferred embodiment, illustrating how a rotary bit retaining member thereof is removed.
Figure 7:
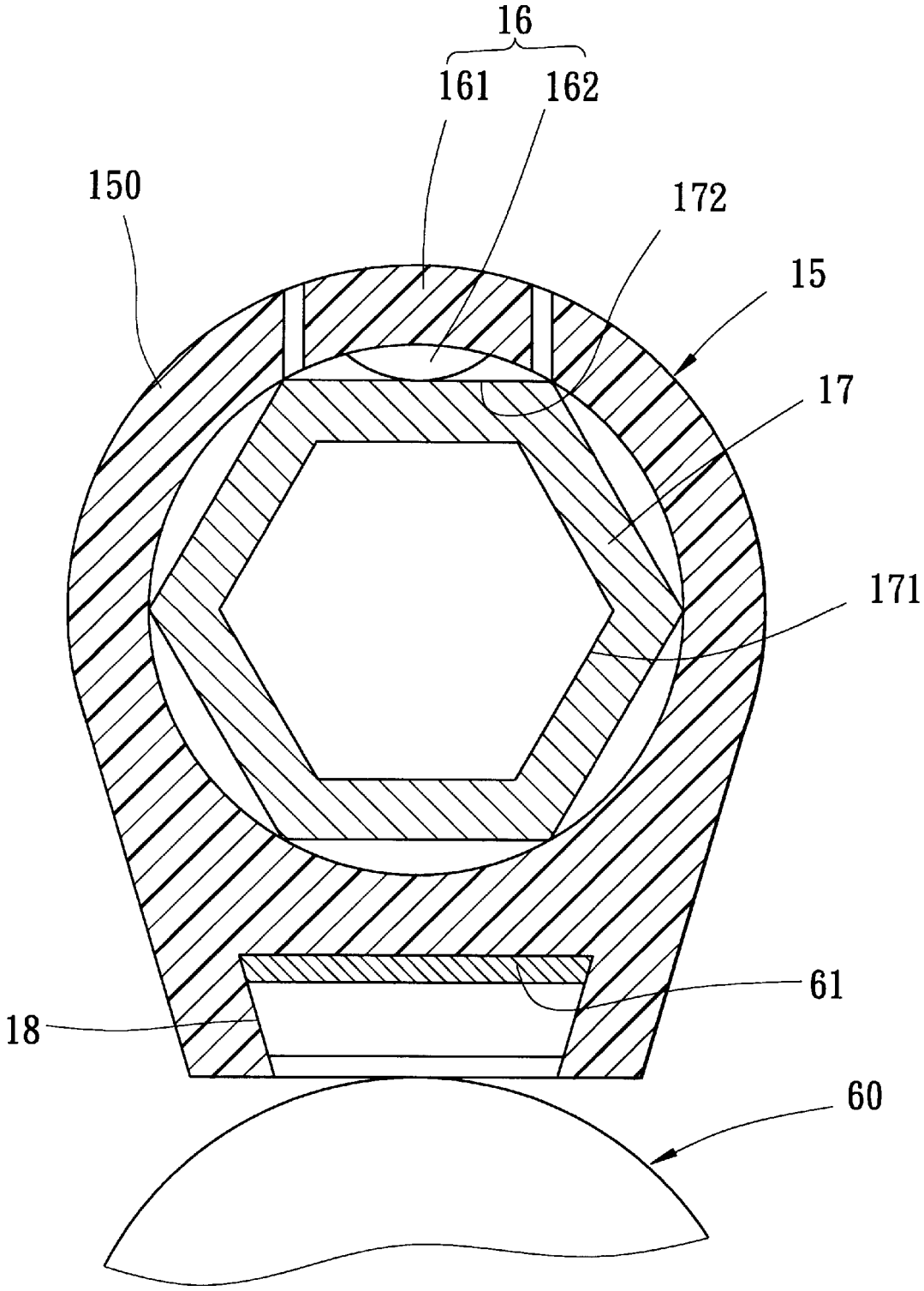
FIG. 7 is a cross sectional view showing a bit operating tube employed in the preferred embodiment and taken along line 7—7 in FIG. 4.

The locking device 30 includes a mounting bolt 32 that passes through a locking tab 31 and a biasing spring 33 for fastening the locking tab 31 eccentrically and rotatably on an end face of the mounting axle 14 such that the locking tab 31 projects outwardly of the cover plate 21 via the opening 24 when the cover member 20 is at the first position. The end face of the mounting axle 14 is generally flush with the open end of the circumferential wall 111. Under such a condition, the locking tab 31 can be rotated in a first direction to engage the cover plate 21 and interconnect the mounting axle 14 and the cover member 20, and a second direction to disengage the cover plate 21 and permit movement of the cover member 20 to the second position, as best shown in FIG. 6.

The bit retaining member 40 can be inserted removably into the receiving space 120 from the open end 12 of the circumferential wall 111 when the cover member 20 is at the second position. The bit retaining member 40 has an outer periphery 401, an axial mounting hole 41 for sleeving the bit retaining member 40 rotatably on the mounting axle 14 inside the receiving space 120, and a plurality of axially extending bit retaining holes 42 disposed along a circular line between the mounting hole 41 and the outer periphery 401. The bit retaining member 40 is accessible externally of the casing 10 via the cut-out portion so as to rotate the bit retaining member 40 about the mounting axle 14 in order to align a selected one of the bit retaining holes 42 with the through hole 151 in the end wall 11 and the rod retention tube 23.

The tool bits 70 are disposed in the bit retaining holes 42 in the bit retaining member 40, respectively. The bit retaining member 40 is preferably made from a transparent material in order to permit viewing of the tool bits 70 so as to facilitate selection of a desired one of the tool bits 70. Alternatively, a plurality of indicating marks can be formed on the outer periphery 401 of the bit retaining member 40 to facilitate selection of the desired tool bit 70.

Figure 5:
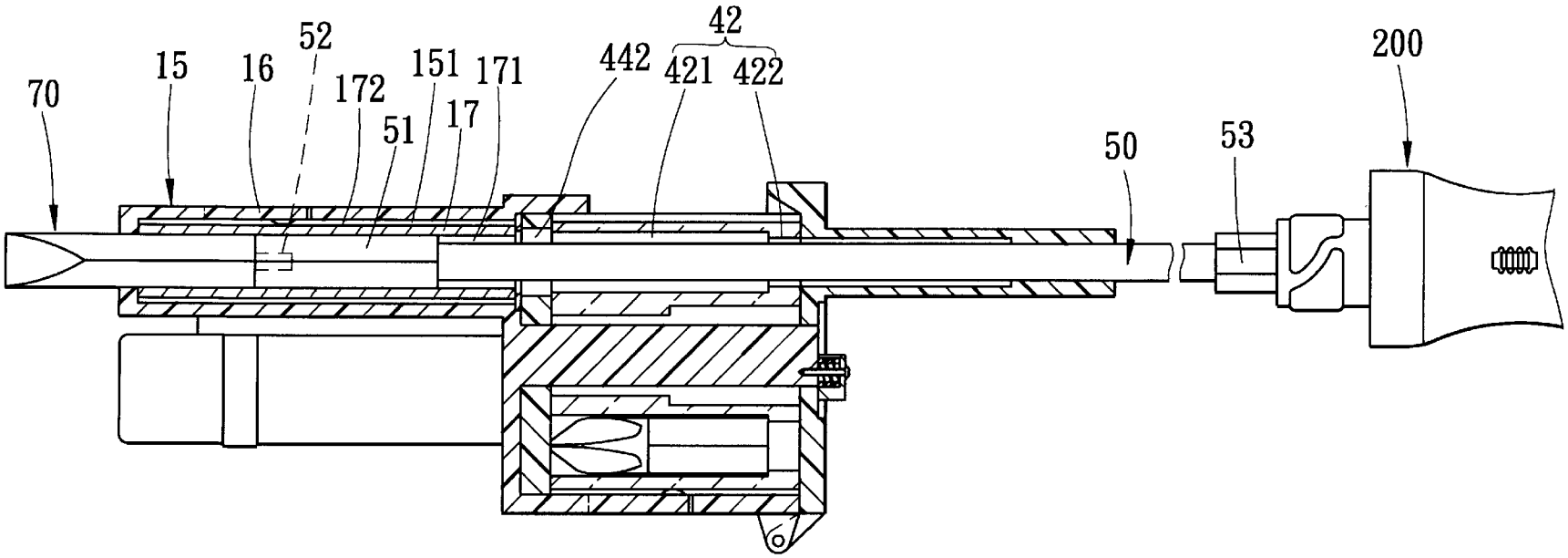
FIG. 5 is a fragmentary sectional view of the preferred embodiment in use.

The push rod 50 has a bit pushing portion 51 that extends slidably into the rod retention tube 23, and an operating portion 53 that extends outwardly from the rod retention tube 23. The push rod 50 is operable so that when the cover member 20 is at the first position, the bit pushing portion 51 can force the tool bit 70 in the selected one of the bit retaining holes 42 to extend through the through hole 151 in the end wall 11 and into the bit operating tube 17 in the sleeve member 15, as best shown in FIG. 5.

In the preferred embodiment, the bit pushing portion 51 of the push rod 50 has a magnet 52 provided thereon for magnetic attraction with the tool bit 70 in the selected one of the bit retaining holes 42. Preferably, each of the tool bits 70 has a tube engaging portion 701 and an operating tip 702 of a particular configuration. The bit operating tube 17 confines a bit passage 171 of a non-circular cross section that conforms with the non-circular cross-section of the tube engaging portions 701 of the tool bits 70 and the bit pushing portion 51 of the push rod 50 to permit simultaneous rotation of the bit operating tube 17 with the push rod 50 and the tool bit 70 in the bit operating tube 17.

The outer circumferential wall 150 of the sleeve member 15 is formed with an inwardly and radially extending flange 152 that cooperates with a washer 1121 to prevent disengagement of the bit operating tube 17 therefrom, and an axially extending engagement slot 18 to permit detachable engagement with a clip member 61 of a torch 60 such that the torch 60 can be operated to emit light in the axial direction of the casing 10.

Preferably, the bit operating tube 17 has an outer circumferential wall 172 of a non-circular cross section. The sleeve member 15 is provided with a first spring-type positioning unit 16 that engages the outer circumferential wall 172 of the bit operating tube 17 to arrest undesired rotation of the bit operating tube 17 in the sleeve member 15. The first spring-type positioning unit 16 includes a leaf spring 161 formed on the sleeve member 15, such as by punching, and provided with a protrusion 162 that projects radially into the receiving space 120.

The outer periphery 401 of the bit retaining member 40 is formed with a plurality of axially extending positioning grooves 43. The circumferential wall 111 of the tubular casing 10 is provided with a second spring-type positioning unit 13 that engages a selected one of the positioning grooves 43 to maintain alignment of the selected one of the bit retaining hole 42 with the bit operating tube 17. Since the second spring-type positioning unit 13 is similar to the first spring-type positioning unit 16 in construction, a description of the same will be omitted herein for the same of brevity.

A bit shielding device is disposed in the receiving space 120 of the tubular casing 10, and includes a shielding plate 44 and a splinted tubular member 45 that extends from the shielding plate 44 and that is disposed around the mounting axle 14 once two lateral sides 441 of the mounting plate 44 are sandwiched by two projections 112 on the end wall 11 (only one is shown in FIG. 3). The tubular member 45 engages frictionally the bit retaining member 40 in the mounting hole 41 such that the bit shielding device is removable together with the bit retaining member 40 from the receiving space 120 of the casing 10 to prevent dropping of the tool bits 70 outwardly from the bit retaining holes 42. The shielding plate 44 is formed with an eccentric through hole 442 aligned with the bit operating tube 17.

The rod retention tube 23 has a first inner wall section 231 of a non-circular cross section proximate to the open end 12 of the circumferential wall 111, a second inner wall section 232 distal relative to the open end 12 of the circumferential wall 111 and smaller than the first inner wall 231 in cross-section, and a first shoulder 233 formed between the first and second inner wall sections 231,232. The cross-section of the bit pushing portion 51 complements the cross-section of the first inner wall section 231 of the rod retention tube 23. The operating portion 53 of the push rod 50 has a cross-section that complements the cross-section of the second inner wall section 232 of the rod retention tube 23 to form a second shoulder 54 between the bit pushing portion 51 and the operating portion 53 such that the second shoulder 54 will be stopped by the first shoulder 233 when the operating portion 51 is pulled away from the retention tube 23.

The hand grip member 200 is connected to the operating portion 53 of the push rod 50, such as via a known ratchet mechanism, to facilitate turning of the bit operating tube 17 in the sleeve member 15.

Each of the bit retaining holes 42 has a first end 422 proximate to the cover member 20, a second end 421 distal relative to the cover member 20, and a stop 423 between the ends 422,421 to prevent removal of the respective one of the tool bits 70 therefrom in a direction away from the end wall 11 of the circumferential wall 111.

Figure 8:
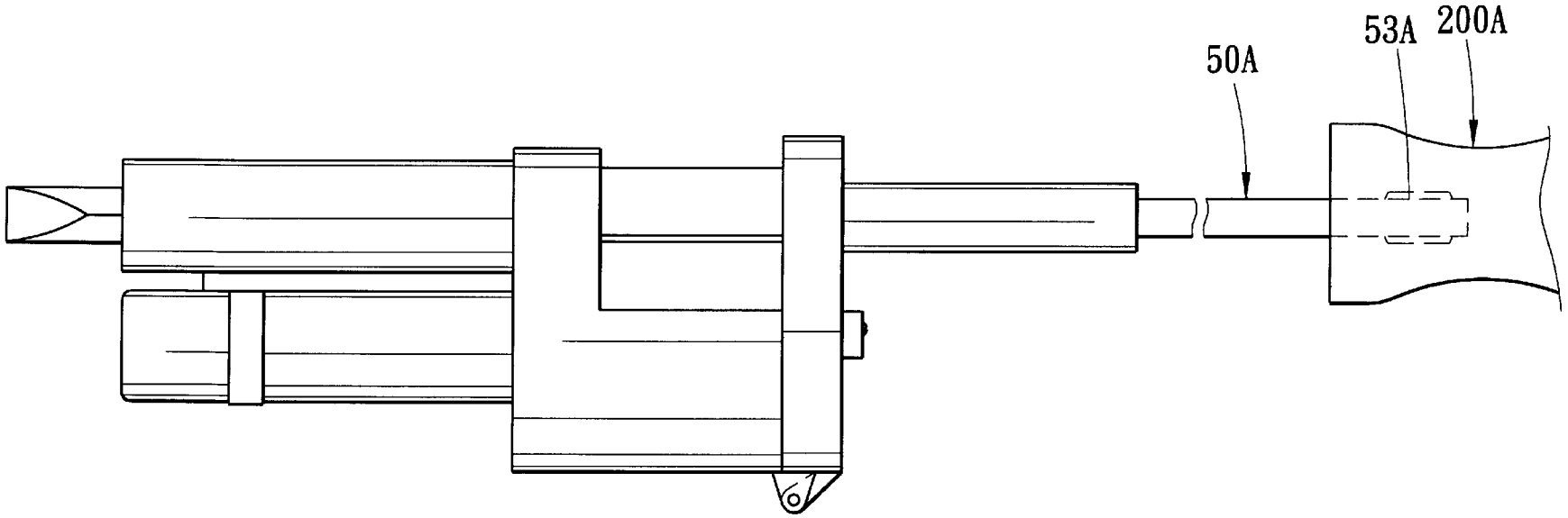
FIG. 8 is a schematic side view of a modified preferred embodiment of the present invention.

Referring to FIG. 8, a modified preferred embodiment of the present invention is shown to be similar to the previous embodiment in structure, except that the operating portion 53A of the push rod 50A is connected fixedly to the hand grip member 200A.

After removal of the bit retaining member 40 from the receiving space 120 of the casing 10, a new set of tool bits 70 can be used to replace the current set that is in use. Moreover, because rotation of the hand grip member only results in corresponding rotation of the bit operating tube 17 and the tool bit 70 therein, and does not result in rotation of the tubular casing 10 and the bit retaining member 40, the tool of the present invention requires a relatively small amount of operating space and a relatively small amount of force when operating on a workpiece.

With this invention thus explained, it is apparent that numerous modifications and variations can be made without departing from the scope and spirit of this invention. It is therefore intended that this invention be limited only as indicated in the appended claims.

I claim:

1. A hand operated tool comprising:

a tubular casing including an end wall having an axis and a through hole formed therethrough and offset from said axis, a circumferential wall extending coaxially from said end wall to form an open end opposite to said end wall, said circumferential wall confining a receiving space between said end wall and said open end, and being formed with a cut-out portion for access into said receiving space, a mounting axle extending coaxially from said end wall into said receiving space, and a cover member mounted on said circumferential wall and movable relative thereto between a first position, where said cover member covers said open end, and a second position, where said cover member uncovers said open end, said cover member having a rod retention tube extending therefrom, said rod retention tube projecting outwardly of said receiving space and being aligned with said through hole in said end wall and being in communication with said receiving space when said cover member is at said first position;

a locking device for releasably locking said cover member at said first position;

a cylindrical rotary bit retaining member inserted removably into said receiving space from said open end when said cover member is at said second position, said bit retaining member having an outer periphery, an axial mounting hole for sleeving rotatably said bit retaining member on said mounting axle insides said receiving space, and a plurality of axially extending bit retaining holes disposed along a circular line between said mounting hole and said outer periphery, said bit retaining member being accessible externally of said casing via said cut-out portion so as to rotate said bit retaining member about said mounting axle in order to align a selected one of said bit retaining holes with said through hole in said end wall and said rod retention tube;

a plurality of tool bits disposed in said bit retaining holes, respectively; and a push rod having a bit pushing portion slidably extending into said rod retention tube, and an operating portion extending outwardly from said rod retention tube and operable so that when said cover member is at said first position, said bit pushing portion can force said tool bit in the selected one of said bit retaining holes to extend through said through hole in said end wall.

2. The hand operated tool as defined in claim 1, wherein said bit pushing portion of said push rod has a magnet provided thereon for magnetic attraction with said tool bit in the selective one of said bit retaining holes.

3. The hand operated tool as defined in claim 1, wherein said end wall is further formed with a hollow sleeve member disposed around said through hole and extending outwardly of said receiving space parallel to said mounting axle, said tool bit in the selected one of said bit retaining holes being forced by said bit pushing portion to extend into said hollow sleeve member.

4. The hand operated tool as defined in claim 3, further comprising a bit operating tube disposed rotatably in said hollow sleeve member, said tool bit in the selected one of said bit retaining holes being forced by said bit pushing portion to extend into said bit operating tube.

5. The hand operated tool as defined in claim 4, wherein each of said tool bits has a tube engaging portion and an operating tip extending from said tube engaging portion, said tube engaging portion and said bit pushing portion of said push rod being of a non-circular cross section, said bit operating tube confining a bit passage of a non-circular cross-section that conforms with the non-circular cross-section of said tube engaging portions of said tool bits and said bit pushing portion of said push rod to permit simultaneous rotation of said bit operating tube with said push rod and said tool bit in said bit operating tube.

6. The hand operated tool as defined in claim 4, wherein said bit operating tube has an outer circumferential wall of a non-circular cross section, said sleeve member being provided with a spring-type positioning unit that engages said outer circumferential wall of said bit operating tube to arrest undesired rotation of said bit operating tube in said sleeve member.

7. The hand operated tool as defined in claim 1, wherein said outer periphery of said bit retaining member is formed with a plurality of axially extending positioning grooves, said circumferential wall being provided with a spring-type positioning unit that engages a selected one of said positioning grooves to maintain alignment of the selected one of said bit retaining hole with said through hole in said end wall.

8. The hand operated tool as defined in claim 7, further comprising a bit shielding device disposed in said receiving space, said bit shielding device including a shielding plate mounted detachably on said end wall, and a splinted tubular member extending from said shielding plate and disposed around said mounting axle, said tubular member engaging frictionally said bit retaining member in said mounting hole of said bit retaining member in such a manner that said shielding device is removable together with said bit retaining member from said receiving space to prevent dropping of said tool bits outwardly from said bit retaining holes.

9. The hand operated tool as defined in claim 8, wherein said shielding plate further has an eccentric through hole aligned with said bit operating tube to permit passage of said tool bit in the selected one of said bit retaining holes when said tool bit in the selected one of said bit retaining holes is forced by said bit pushing portion to extend into said bit operating tube.

10. The hand operated tool as defined in claim 5, wherein said rod retention tube has a first inner wall section of a non-circular cross-section proximate to said open end of said circumferential wall, a second inner wall section distal relative to said open end of said circumferential wall and smaller than said first inner wall in cross-section, and a first shoulder formed between said first and second inner wall sections.

11. The hand operated tool as defined in claim 10, wherein the cross-section of said bit pushing portion complements the cross-section of said first inner wall section of said rod retention tube, said operating portion of said push rod having a cross-section that complements the cross-section of said second inner wall section to form a second shoulder between said bit pushing portion and said operating portion such that said second shoulder will be stopped by said first shoulder when said operating portion is pulled away from said rod retention tube.

12. The hand operated tool as defined in claim 1, wherein each of said bit retaining holes has one end proximate to said cover member and formed with a stop to prevent removal of the respective one of said tool bits therefrom in a direction away from said end wall.

13. The hand operated tool as defined in claim 1, further comprising a bit operating tube mounted rotatably on said end wall and disposed outwardly of said receiving space, said bit operating tube being coaxial with said through hole in said end wall so that said tool bit in the selected one of said bit retaining holes can be forced by said bit pushing portion to extend into said bit operating tube.

14. The hand operated tube as defined in claim 13, wherein each of said tool bits has a tube engaging portion and an operating tip extending from said tube engaging portion, said tube engaging portion and said pushing portion of said push rod being of a non-circular cross-section, said bit operating tube confining a bit passage of a non-circular cross-section that conforms with the non-circular cross-section of said tube engaging portions of said tool bits and said bit pushing portion of said push rod to permit simultaneous rotation of said bit operating tube with said push rod and said tool bit in said bit operating tube.

15. The hand operated tool as defined in claim 1, further comprising a hand grip member connected to said operating portion of said push rod.

16. The hand operated tool as defined in claim 1, wherein said cover member includes a cover plate and a peripheral wall extending from said cover plate, said tubular casing further including a pivot member for connecting pivotally said peripheral wall and said circumferential wall about a pivot axis transverse to said mounting axle.

17. The hand operated tool as defined in claim 16, wherein said cover plate is formed with an opening aligned with said mounting axle, said mounting axle having an end face adjacent to said open end of said circumferential wall, said locking device including a locking tab mounted eccentrically and rotatably on said end face of said mounting axle and projecting outwardly of said opening in said cover plate when said cover member is at said first position such that said locking tab can be rotated in a first direction to engage said cover plate and interconnect said mounting axle and said cover member, and in a second direction to disengage said cover plate and permit movement of said cover member to said second position.

* * * * *